US007798499B2

(12) United States Patent
Gregory

(10) Patent No.: US 7,798,499 B2
(45) Date of Patent: Sep. 21, 2010

(54) WHEELED LUGGAGE USABLE AS A SEAT

(76) Inventor: David G. Gregory, 2775 35th St., Coos Bay, OR (US) 97420

( * ) Notice: Subject to any disclaimer, the term of this patent is extended or adjusted under 35 U.S.C. 154(b) by 379 days.

(21) Appl. No.: 11/784,306

(22) Filed: Apr. 5, 2007

(65) Prior Publication Data

US 2007/0235964 A1 Oct. 11, 2007

Related U.S. Application Data

(60) Provisional application No. 60/791,610, filed on Apr. 11, 2006, provisional application No. 60/903,242, filed on Feb. 24, 2007.

(51) Int. Cl.
*B62D 33/08* (2006.01)

(52) U.S. Cl. ..... 280/43.1; 280/47.17; 188/1.12

(58) Field of Classification Search ..... 280/37, 280/DIG. 3, 43.1, 652, 47.131, 47.17, 47.315; 190/8, 18 A; 16/18 R, 35 R, 44, 45; 297/217.1; 188/1.12
See application file for complete search history.

(56) References Cited

U.S. PATENT DOCUMENTS

| | | | | |
|---|---|---|---|---|
| 2,885,720 | A * | 5/1959 | Seeberger | 16/44 |
| 2,942,290 | A * | 6/1960 | Segal | 16/35 R |
| 4,066,154 | A | 1/1978 | Ross | |
| 4,821,369 | A * | 4/1989 | Daniels | 16/35 R |
| 5,873,145 | A | 2/1999 | Chou | |
| 5,875,519 | A | 3/1999 | Chou | |
| 6,382,736 | B1 | 5/2002 | Chang | |
| 6,471,019 | B1 * | 10/2002 | Miller | 190/11 |
| 6,550,860 | B2 * | 4/2003 | Lombardi | 297/217.1 |
| 6,758,534 | B2 | 7/2004 | Lampugnani | |
| 6,769,701 | B1 | 8/2004 | Clausen | |
| 7,175,002 | B2 * | 2/2007 | Chiang | 188/1.12 |
| 7,195,322 | B2 * | 3/2007 | Lin et al. | 301/111.05 |
| 2004/0251717 | A1 | 12/2004 | Tamura | |
| 2005/0077706 | A1 | 4/2005 | O'Shea | |
| 2006/0102435 | A1 | 5/2006 | Chiang | |
| 2007/0089952 | A1 * | 4/2007 | Herbst et al. | 190/8 |
| 2007/0145700 | A1 * | 6/2007 | Ambrose et al. | 280/47.26 |

* cited by examiner

*Primary Examiner*—Lesley Morris
*Assistant Examiner*—John D Walters
(74) *Attorney, Agent, or Firm*—Robert E. Howard

(57) ABSTRACT

A wheel assembly for use on wheeled luggage usable as a seat A seat cushion is located on the upper end of the luggage. The wheel assembly includes a wheel housing having a brake shoe located within the housing. A wheel carriage is positioned within the housing. The wheel carriage rotatably supports a wheel having a rolling surface. In response to a traveler sitting on the seat cushion, the wheel carriage has means adapted to allow the wheel to move from a first position where the rolling surface of the wheel is not in contact with the brake shoe to a second position where the rolling surface of the wheel is in braking contact with the brake shoe, and to cause the wheel to move from the second position to the first position upon the traveler arising.

13 Claims, 5 Drawing Sheets

WHEELED LUGGAGE USABLE AS A SEAT

CROSS-REFERENCE TO RELATED APPLICATIONS

This application claims the benefit of U.S. Provisional Application No. 60/791,610, filed Apr. 11, 2006, and U.S. Provisional Application No. 60/903,242, filed Feb. 24, 2007, the entire contents of both of which provisional applications are hereby incorporated by reference.

BACKGROUND OF THE INVENTION

The present invention relates to wheeled luggage that can be safely used as a seat.

Air travelers typically have a piece of carry on luggage that can be stowed in the overhead bin of the airplane, or under the seat in front of the traveler. In view of the long distances most travelers must walk at an airport, the most popular type of carry on luggage is one that has a pair of wheels and an extendable/retractable handle that allows the traveler to tow the luggage on a towing surface such as a floor.

Airports have become more and more crowded, and security lines longer and longer. Seats in the immediate area of a departure gate are often all taken. Seating is not available in security lines, in baggage claim areas, in car rental lines, and other places.

Suggestions have been made to attach a seat to wheeled luggage to provide the traveler with a place to sit.

U.S. Pat. No. 6,644,447 describes seats that swivel upwardly from the front or back sides of a wheeled suitcase.

U.S. Pat. No. 6,932,427 describes a wheeled suitcase with a chair that folds down from the front side.

U.S. Patent Application Publication 2004/0231939 describes a seat that can be swivelled upwardly from the back side of a wheeled suitcase.

U.S. Patent Application Publication 2005/0098402 describes a wheeled suitcase that has a lounge chair that can be swivelled upwardly from the front side when the suitcase is laid down on its back side.

U.S. Patent Application Publication 2005/0194226 describes a wheeled suitcase that has a seat that can be swivelled downwardly from the back side.

All of these devices are complicated, add unwanted weight to the luggage, and are unsafe as the wheels may cause the suitcase to move when being used as a seat.

Attempts to sit on top of a wheeled suitcase is likewise unsafe due to the high potential for movement of the suitcase.

SUMMARY OF THE PRESENT INVENTION

It is an object of the present invention to provide wheeled luggage that is safe to sit on.

The wheeled luggage includes a seat cushion that forms the upper end of the suitcase.

The wheeled luggage includes a wheel assembly located at each lower corner of the front of the suitcase.

Each wheel assembly includes a wheel housing having a brake shoe located within the housing. A wheel carriage is positioned within each of the housings. The wheel carriage rotatably supports a wheel having a rolling surface. In response to a traveler sitting on the seat cushion, the wheel carriage has means adapted to cause the wheel to move from a first position where the rolling surface of the wheel is not in contact with the brake shoe to a second position where the rolling surface of the wheel is in braking contact with the brake shoe.

DESCRIPTION OF PREFERRED EMBODIMENTS

Figure 11:
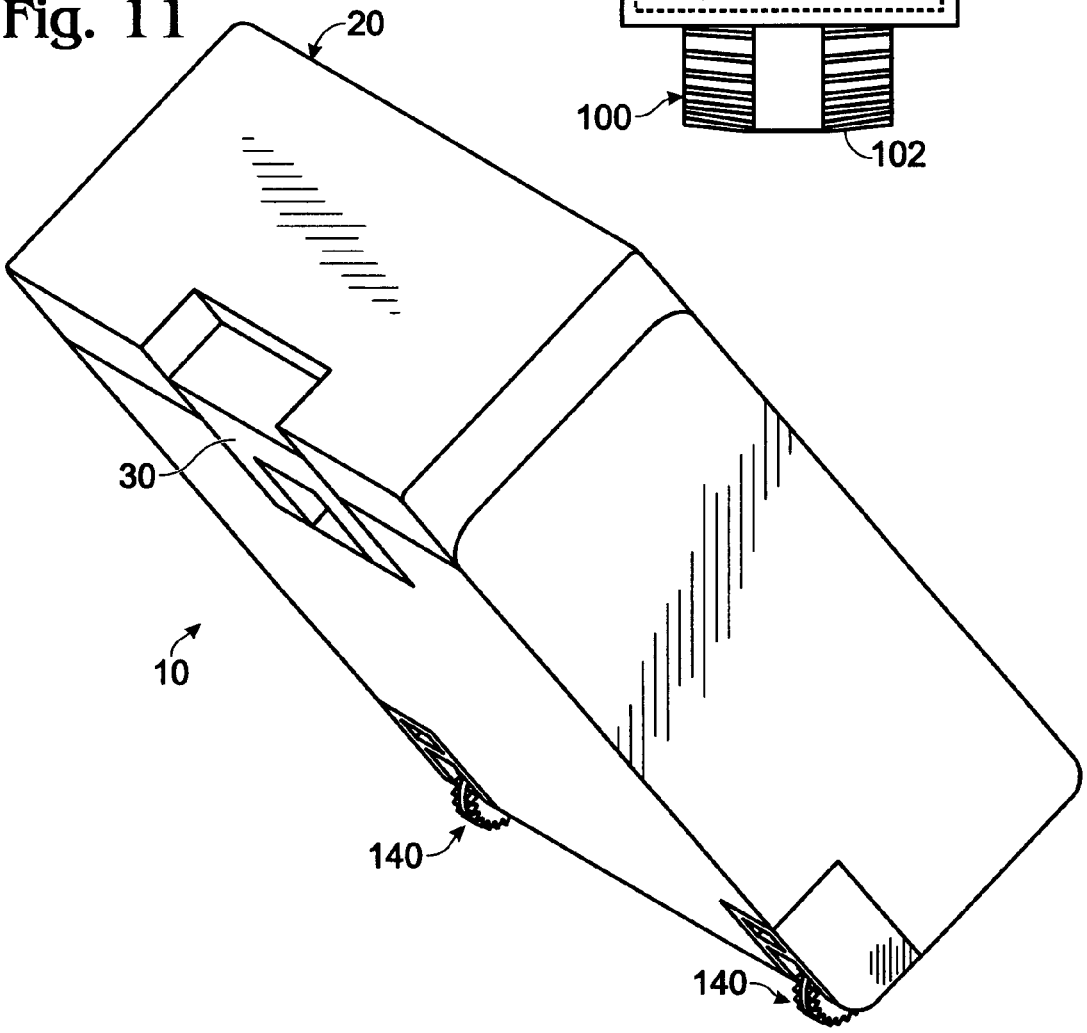
FIG. 11 is a front perspective view of wheeled luggage employing the wheel assembly of the second embodiment.
Figure 10:
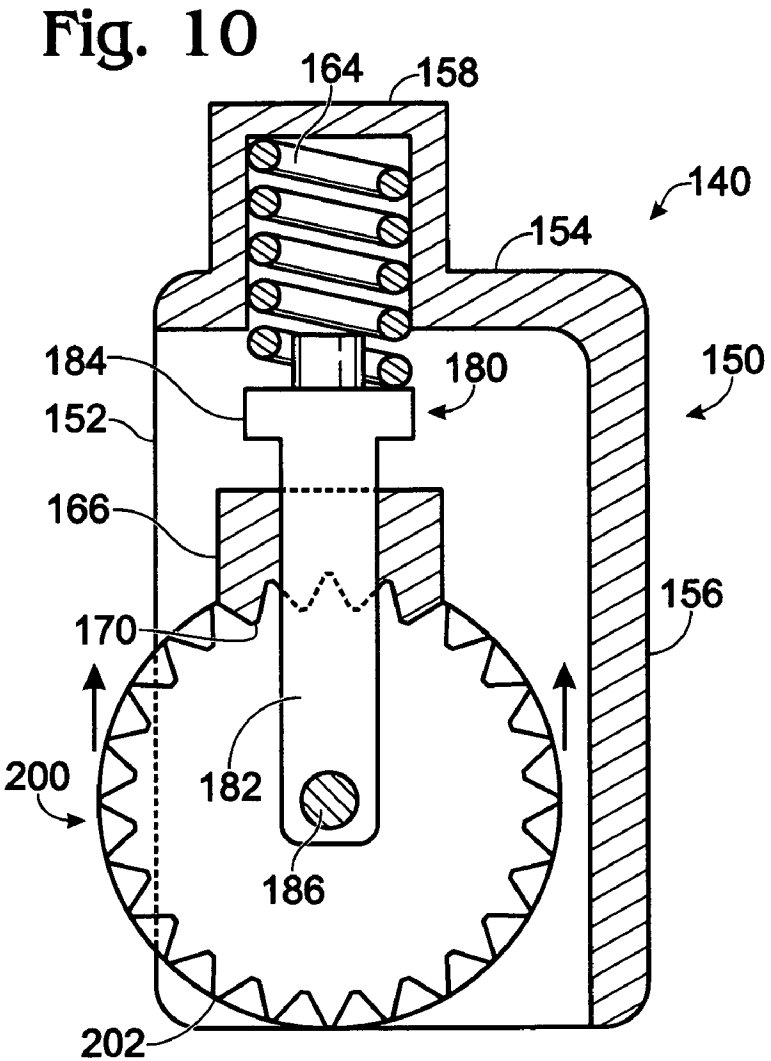
FIG. 10 is a cross-sectional side view of a second embodiment of the wheel assembly with the wheel shown in its locked, non-rotatable position.
Figure 9:
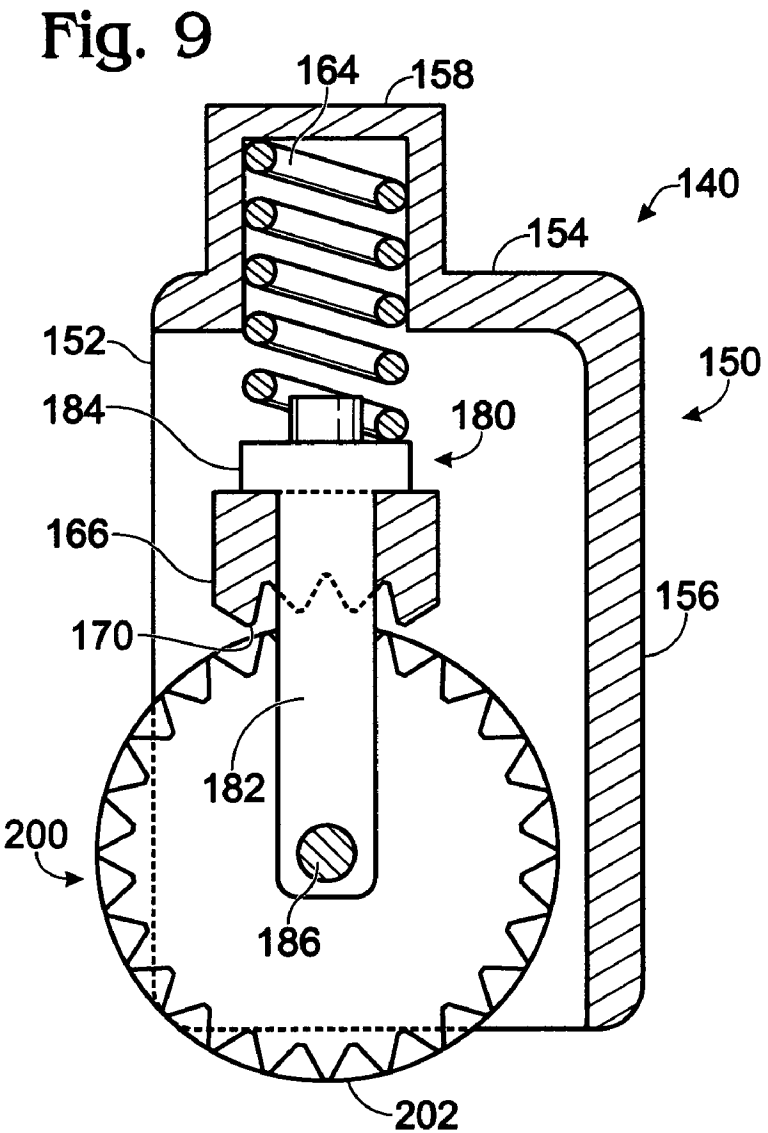
FIG. 9 is a cross-sectional side view of a second embodiment of the wheel assembly with the wheel shown in its unlocked, rotatable position.

As shown in FIG. 11, the wheeled luggage 10 includes cushion seat 20 located on the top panel thereof, telescoping handle 30 located on the front panel thereof, and right and left wheel assemblies 140 located on the right and left lower front corners at the intersection of the front, bottom and side panels thereof. The right and left wheel assemblies 140 of the second embodiment (as seen in FIG. 9-11) are identical. The term "front" means, that side of wheeled luggage 10 that faces the traveler during towing.

Right and left wheel assemblies 140 can be replaced by right and left wheel assemblies of the first embodiment of the invention shown in FIGS. 1-8, only the left wheel assembly 40 of the first embodiment being shown. The right wheel assembly of the first embodiment is a mirror image of left wheel assembly 40.

The left wheel assembly 40 of the first embodiment includes a wheel housing 50 and a wheel carriage 80.

Wheel housing 50 has an upwardly extending lip portion 52 adapted to abut against the lower rear portion of the wheeled suitcase, and be attached thereto by screws passing through mating openings in the rear panel of the suitcase and into screw receptors 54, 54'. Right and left screw holes 56, 56' allow screws to attach the bottom portion of housing 50 to the bottom of the wheeled suitcase. A flange 58 located on the left side of housing 50 abuts the lower left side of the wheeled suitcase. The housing of the right wheel assembly would be identical to the housing 50 of the left wheel assembly 40 except flange 58 would be located on the right side of housing 50 to abut the lower right side of the wheeled suitcase.

Wheel well 60 of wheel housing 50 is adapted to receive wheel carriage 80 and associated wheel 100. Extending outwardly from wheel well 60 is a hollow, cylindrical spring housing 62 adapted to receive and hold spring 64 which extends into wheel well 60 and into contact with wheel carriage 80, as shown. Spring 64 is selected to resist substantial movement of wheel carriage 80 during towing of wheeled luggage 10 filled with normal contents, but to allow movement upon a traveler sitting on seat cushion 20.

A rectangular brake shoe 66 is attached to, or forms a part of, wheel housing 50, and extends into wheel well 60 through opening 96 in wheel carriage 80. The outer surface 70 of brake shoe 66 is arcuate, having a radius substantially identical to the radius of wheel 100, and has a raised patterned surface adapted to mate and interlock with the raised patterned surface 102 of wheel 100 upon contact therewith.

Right and left pivot pin openings 72 extend through the lower right and left side walls of wheel well 60, only the right pivot pin opening 72 being shown, the left pivot opening being opposite right pivot pin opening 72 and in alignment therewith.

Wheel carriage 80 has right and left side walls 82, 82' which are substantially parallel to each other. A top 84 and an angled rear wall 86 extend between right and left side walls 82, 82'. Right and left tongue portions 88, 88' extend forwardly from right and left side walls 82, 82' of tongue portions 88, 88'. Right and left pivot pin openings 90, 90' pass through the walls of right and left tongue portions 88, 88'. Right and left axle openings 92, 92' pass through right and left side walls 82, 82'.

Wheel carriage 80 has a sloping front wall 94 having a rectangular opening 96 therein. Rectangular opening 96 is adapted to receive rectangular brake shoe 66 therethrough.

Wheel 100 is located between right and left side walls 82, 82' of wheel carriage 80, and an axle 104 passes through right and left axle openings 92, 92' and is secured by any suitable means. The outer ends of axle 104 ride in grooves 74, 74' located in the walls of wheel well 60 of wheel housing 50 to prevent wheel carriage 80 from falling out of wheel well 60 when the wheeled luggage 10 is picked up.

Wheel carriage 80, with wheel 100 rotatably attached thereto by axle 104, is then placed within wheel well opening 70 of housing 50 with right and left pivot pin openings 90, 90' in alignment with right and left pivot pin openings 72, 72' in housing 50. A pivot pin 94 is inserted through openings 72, 72', 90, and 90' and attached to housing 50 in any suitable manner.

Right and left wheel assemblies 40 are attached to the right and left sides of the lower portion of a suitcase in a manner well known in the wheeled luggage art, in the positions shown in FIG. 11 for right and left wheel assemblies 140.

In use, handle 30 of the rolling suitcase 10 is extended, and the traveler pulls the suitcase behind him or her. During rolling transport of suitcase 10, wheel carriage 80 and wheel 100 are in the configuration shown in FIG. 3, the wheel surface 102 being urged out of contact with brake shoe 66 by the action of spring 64 pushing against wheel carriage 80.

Figure 2:
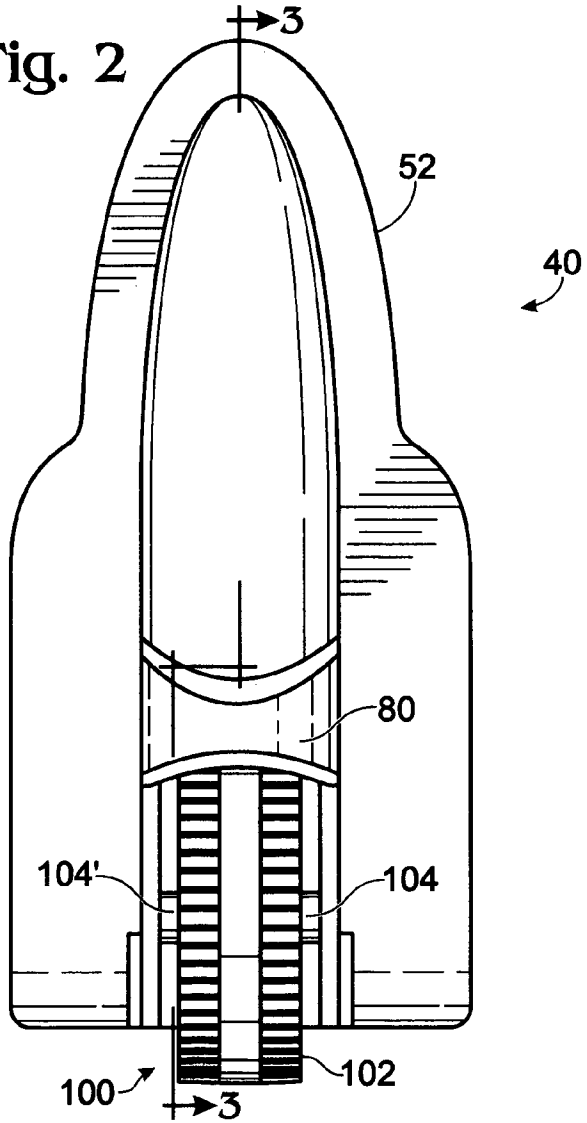
FIG. 2 is a rear elevation view of the first embodiment of the wheel assembly.
Figure 1:
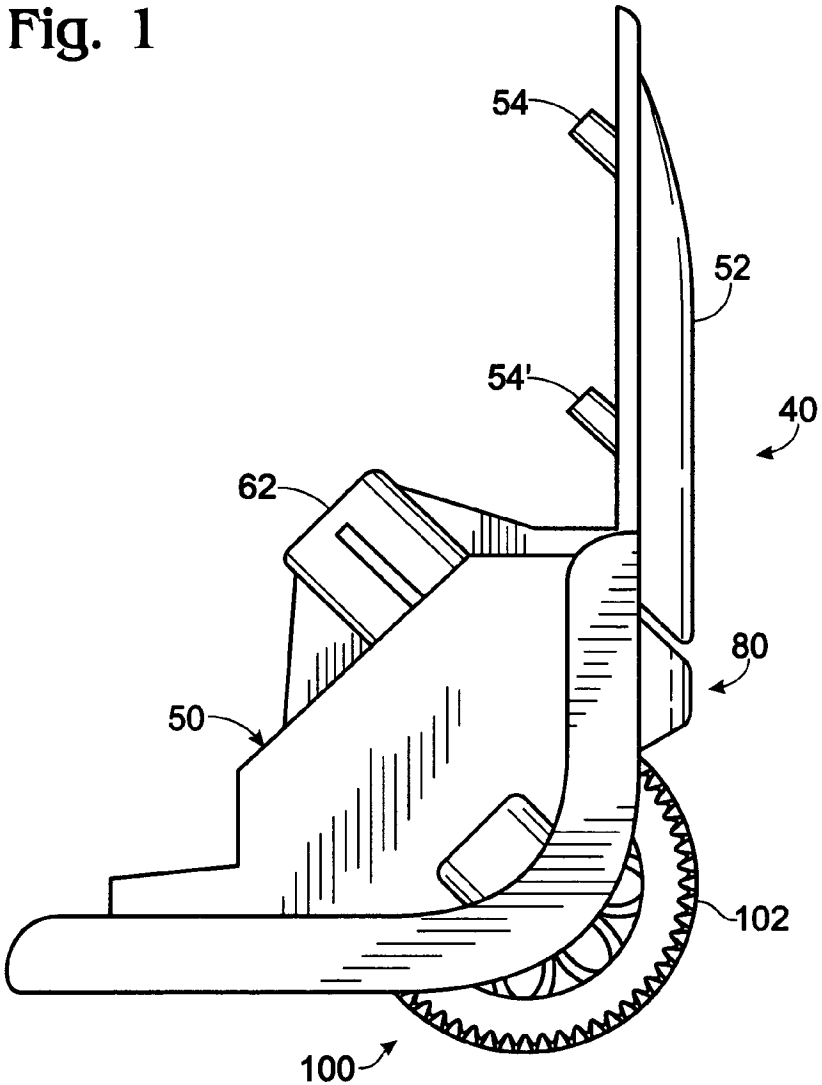
FIG. 1 is a side elevation view of a first embodiment of a wheel assembly for the wheeled luggage of the present invention.
Figure 4:
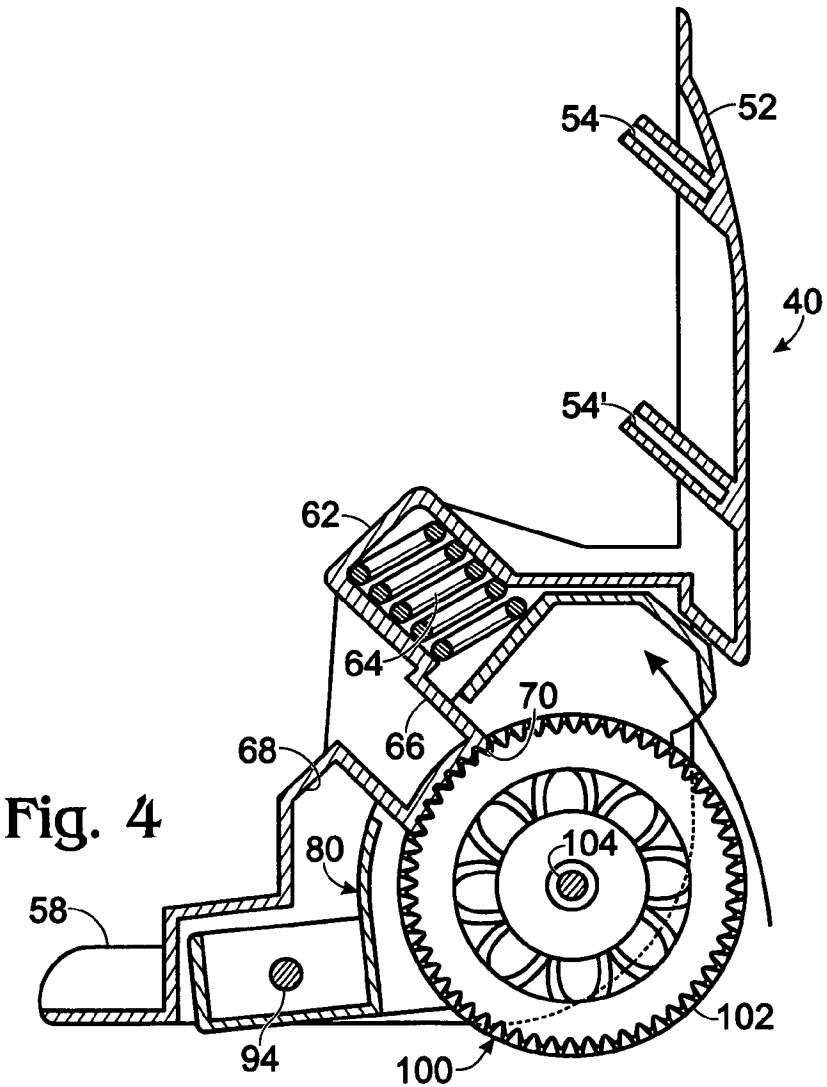
FIG. 4 is a cross-sectional side view of the first embodiment of the wheel assembly showing the wheel in its locked, non-rotatable position.
Figure 3:
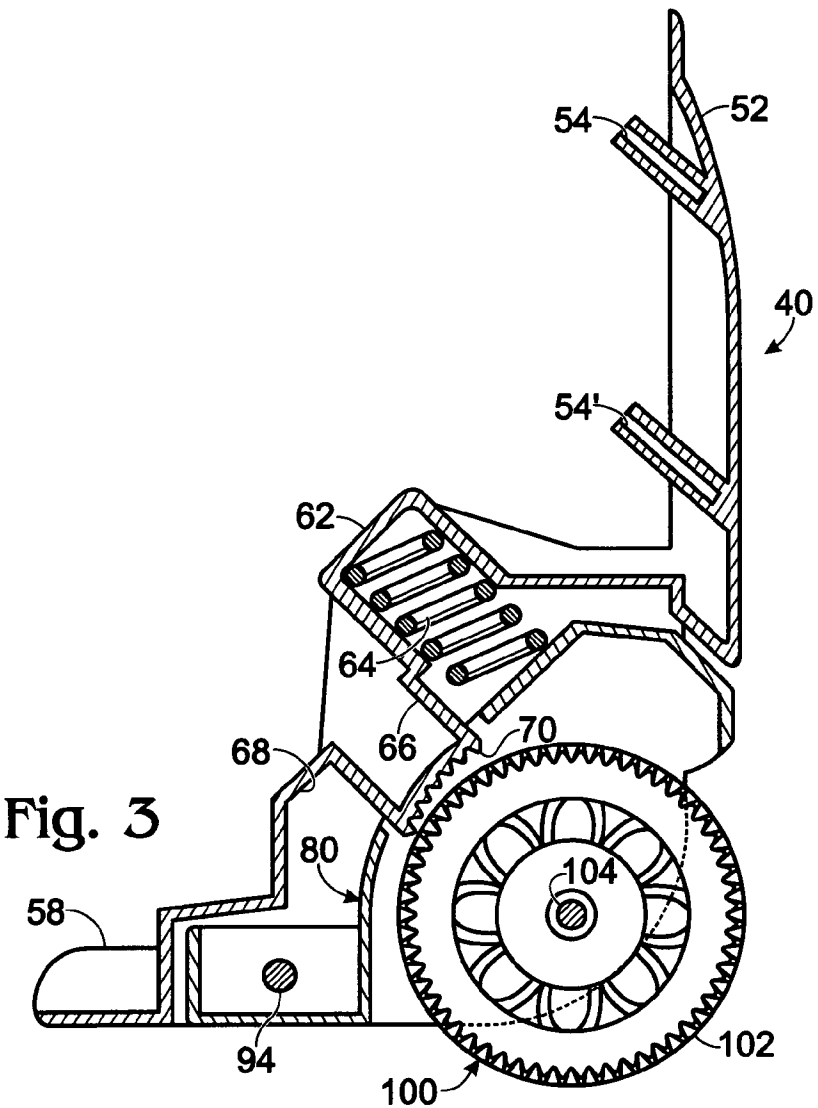
FIG. 3 is a cross-sectional side view of the first embodiment of the wheel assembly showing the wheel in its unlocked, rotatable position.
Figure 7:
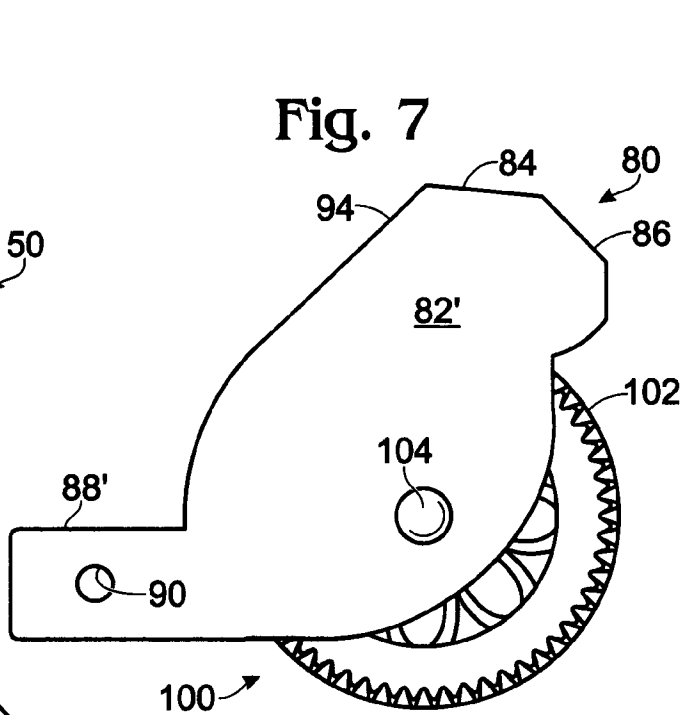
FIG. 7 is a side elevation view of the wheel and its wheel carriage of the first embodiment of the wheel assembly.
Figure 6:
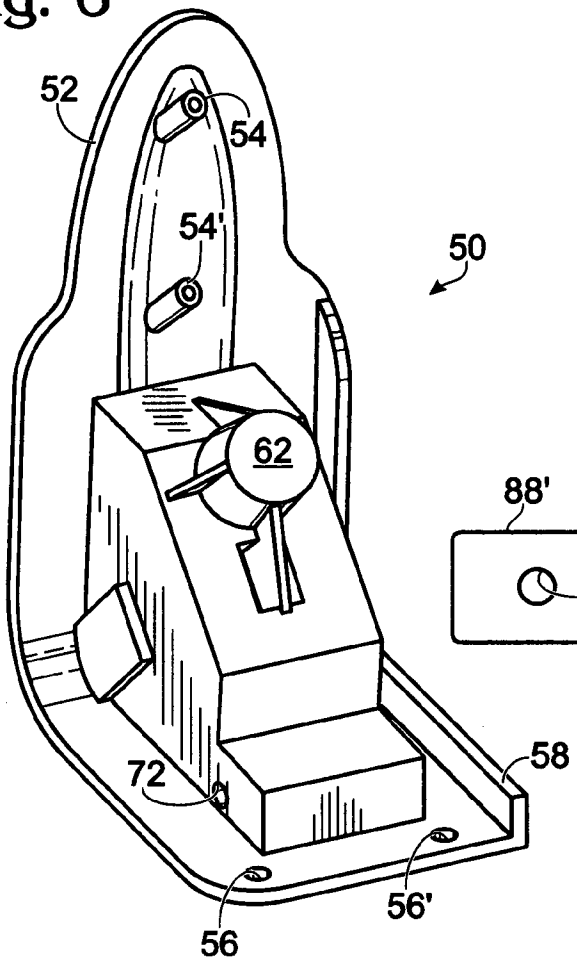
FIG. 6 is a front perspective view of the wheel housing of the first embodiment of the wheel assembly.
Figure 5:
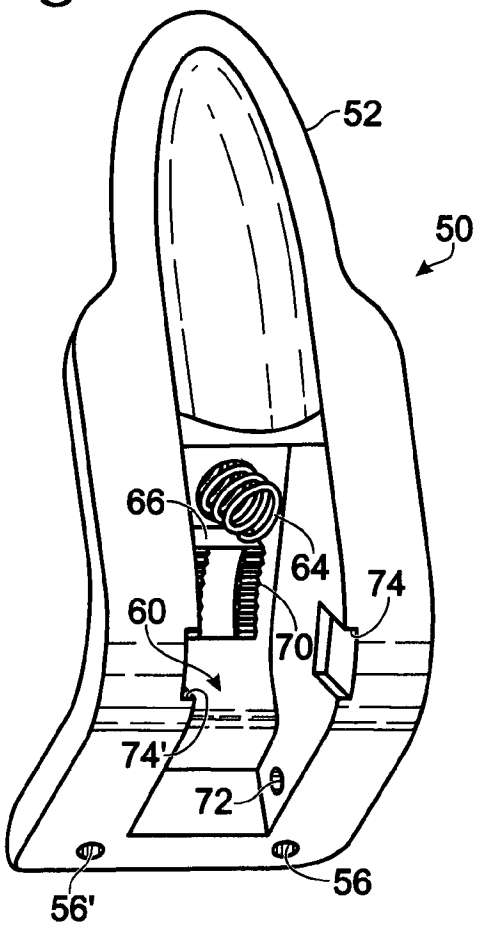
FIG. 5 is a rear perspective view of the wheel housing of the first embodiment of the wheel assembly.
Figure 8:
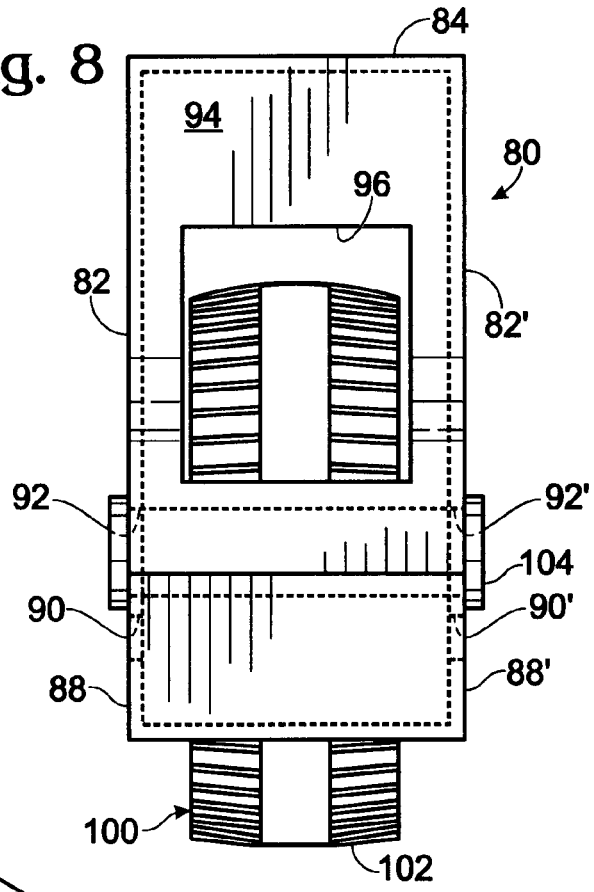
FIG. 8 is a front elevation view of the wheel and its wheel carriage of the first embodiment of the wheel assembly.

Upon reaching a location where a wait is required and it is desired to be seated, handle 30 is retracted, and the traveler sits on seat cushion 20. Upon the traveler being seated, wheel carriage 80 pivots about pivot pin 94 compressing spring 64 until the rolling surface 102 of wheel 100 comes into contact with the arcuate outer surface 70 of brake shoe 66, as shown in FIG. 4. In FIG. 4 wheel 100 is shown partially retracted into wheel well 70. However, wheel carriage 80 and wheel 100 can be adapted to be wholly retracted into wheel well 70 before contact of the rolling surface 102 of wheel 100 is made with the arcuate outer surface 70 of brake shoe 66. The matching raised patterns of outer surface 70 of brake shoe 66 and rolling surface 102 of wheel 100 meshingly engage, thereby preventing wheel 100 from rotating for so long as the traveler is seated.

Although it is preferred to have the pattern of the rolling surface 102 of wheel 100 meshingly engage with the pattern of the arcuate outer surface 70 of brake shoe 66, the arcuate outer surface 70 could be made of a deformable rubber or elastomeric material to allow the pattern of rolling surface 102 to embed into the arcuate outer surface 70 to cause a braking action or, vice versa, the rolling surface 102 could be made of a rubber or elastomeric material to allow the pattern of the arcuate outer surface 70 of brake shoe 66 to embed into rolling surface 102 to cause a braking action.

Upon the traveler arising, spring 64 urges wheel carriage 80 away and causes brake shoe 66 and wheel 100 to disengage and allow wheel 100 to rotate.

Although spring 64 is preferably attached to wheel housing 50, as shown, it could be attached to wheel carriage 80.

The second wheel assembly embodiment 140, shown in FIGS. 9-11, employs a similar braking mechanism. However, in the second embodiment the wheel moves in a substantially vertical direction rather than pivoting during engagement of the wheel with the brake shoe.

Wheel assembly 140 includes a wheel housing 150 and a wheel carriage 180.

Wheel housing 150 includes substantially parallel right and left side walls 152 and 152', top wall 154, and rear wall 156. A hollow cylindrical spring housing 158 extends upwardly from the top wall 154. Spring housing 158 has a spring 164 mounted therein.

A brake shoe 166 has an arcuate surface 170 having a radius substantially the same as the radius of wheel 200. The arcuate surface 170 has a raised pattern that can matingly engage the raised pattern 202 of wheel 200. Alternatively, either the arcuate surface 170 or the rolling surface 202 of wheel 200 could be formed of a rubber or elastomeric material to allow the embedding and braking action discussed above relative to the first embodiment.

Wheel carriage 180 includes an inverted, generally U-shaped yoke comprised of opposing right and left arms 182 (only the left arm 182 being shown) and upper cross-plate 184. Upper cross plate engages the lower end of spring 164.

Right and left arms 182 have opposed axle receiving openings therein for receiving axle 186 therethrough. The outer ends of axle 186 extend into and slidably engage right and left grooves (not shown) located in the interior wall of right and left side walls 152, 152' of wheel housing 150.

In use, handle 30 of the rolling suitcase 10 is extended, and the traveler pulls the suitcase behind him or her. During rolling transport of suitcase 10, wheel carriage 180 and wheel 200 are in the configuration shown in FIG. 9.

Upon reaching a location where a wait is required and it is desired to be seated, handle 30 is retracted, and the traveler sits on seat cushion 20. Upon the traveler being seated, wheel carriage 180 moves vertically upward until the rolling surface 202 of wheel 200 comes into contact with the arcuate surface 170 of brake shoe 166, as shown in FIG. 10. In FIG. 10 wheel 200 is shown partially retracted into wheel housing 150. However, wheel carriage 180 and wheel 200 can be adapted to be wholly retracted into wheel housing 150 before contact of the rolling surface 202 of wheel 200 with the arcuate outer surface of brake shoe 166 is made. The matching raised patterns of the inner surface of channel 170 of brake shoe 166 and outer surface 202 of wheel 200 meshingly engage, thereby prevent wheel 200 from rotating for so long as the traveler is seated.

Upon the traveler arising, spring 164 urges wheel carriage 180 downwardly and causes brake shoe 166 and wheel 200 to disengage and allow wheel 200 to rotate.

It will be obvious to those having skill in the art that many changes may be made to the details of the above-described embodiments of this invention without departing from the underlying principles thereof. The scope of the present invention should, therefore, be determined only by the following claims.

The invention claimed is:

1. Wheeled luggage comprising:

a case having a top panel, bottom panel, front panel, rear panel, and side panels;

said top panel forming a cushion seat;

a telescoping handle extending from the front of the top panel; and a right and left wheel assembly attached to the lower right and left front corners located at the intersection of the front, bottom, and side panels, respectively, of said case;

each of said wheel assemblies including:

a wheel housing having a wheel well;

a brake shoe extending into said wheel well of said wheel housing;

a wheel carriage positioned within said wheel well of said wheel housing, said wheel carriage rotatably supporting a wheel having a rolling surface, said wheel carriage having means adapted to allow said wheel to move from a first position where the rolling surface of said wheel is not in contact with said brake shoe to a second position where said rolling surface of said wheel is in braking contact with said brake shoe, said wheel moving from said first position to said second position upon a traveler sitting on said cushion, and to cause said wheel to move from said second position to said first position upon said traveler arising;

said brake shoe having an arcuate outer surface adapted to contact the rolling surface of said wheel when said wheel is in its second position, said arcuate outer surface having a radius substantially the same as the radius of said wheel;

said rolling surface of said wheel and said arcuate outer surface of said brake shoe each having a raised pattern adapted to mate and interlock.

2. The wheeled luggage of claim 1 wherein said means adapted to allow said wheel to move from a first position to a second position is a pivot pin which attaches said wheel carriage to said wheel housing.

3. The wheeled luggage of claim 1 including means located within said wheel well for urging said wheel carriage out of contact with said brake shoe when said pressure is removed.

4. The wheeled luggage of claim 3 wherein said means for urging said wheel carriage out of contact with said brake shoe is a spring.

5. The wheeled luggage of claim 4 wherein said spring is attached to said wheel housing.

6. The wheeled luggage of claim 1 wherein said brake shoe is attached to said wheel housing and extends into said wheel well through an opening in said wheel carriage.

7. The wheeled luggage of claim 1 wherein said wheel is rotatably attached to said wheel carriage by an axle, the outer ends of said axle extending beyond said wheel and into grooves formed in the adjacent walls of said wheel housing, said grooves adapted to allow said outer ends of said axle to ride therein during movement of said wheel from said first position to said second position.

8. The wheeled luggage of claim 1 wherein said means adapted to allow said wheel to move from a first position to a second position is a yoke to which said wheel is rotatably attached, said yoke adapted to move in a substantially vertical direction upon said upward pressure being applied to said wheel.

9. The wheeled luggage of claim 8 including means located within said wheel well for urging said wheel carriage out of contact with said brake shoe when said pressure is removed.

10. The wheel assembly of claim 9 wherein said means for urging said wheel carriage out of contact with said brake shoe is a spring.

11. The wheeled luggage of claim 10 wherein said spring is attached to said wheel housing.

12. The wheeled luggage of claim 8 wherein said brake shoe has an arcuate outer surface adapted to contact the rolling surface of said wheel when said wheel is in its second position, said arcuate outer surface having a radius substantially the same as the radius of said wheel.

13. The wheeled luggage of claim 12 wherein said rolling surface of said wheel and said arcuate outer surface of said brake shoe have interlocking patterns.

* * * * *